US012150495B2

(12) United States Patent
Ishiguro

(10) Patent No.: US 12,150,495 B2
(45) Date of Patent: Nov. 26, 2024

(54) SEAMLESS MALE GARMENT

(71) Applicant: ISHI STUDIOS, INC., Burlington (CA)

(72) Inventor: Bryan Ishiguro, Burlington (CA)

(73) Assignee: ISHI STUDIOS INC., Burlington (CA)

( * ) Notice: Subject to any disclaimer, the term of this patent is extended or adjusted under 35 U.S.C. 154(b) by 103 days.

(21) Appl. No.: 17/246,215

(22) Filed: Apr. 30, 2021

(65) Prior Publication Data

US 2021/0337882 A1 Nov. 4, 2021

Related U.S. Application Data

(60) Provisional application No. 63/018,175, filed on Apr. 30, 2020.

(51) Int. Cl.
*A41B 9/02* (2006.01)

(52) U.S. Cl.
CPC ..... *A41B 9/023* (2013.01); *A41B 2400/20* (2013.01)

(58) Field of Classification Search
CPC ..... A41B 9/023; A41B 9/02
See application file for complete search history.

(56) References Cited

U.S. PATENT DOCUMENTS 2,191,545 A * 2/1940 Schneider ..... A41C 3/00 450/40
2,285,967 A * 6/1942 Hardy ..... D06M 23/14 264/DIG. 71
2,460,674 A * 2/1949 Bihaly ..... A41C 3/02 D2/709
2,616,084 A * 11/1952 Shearer ..... D04B 21/207 450/40
2,641,257 A * 6/1953 Rutledge ..... A61F 13/72 2/403
2,867,889 A * 1/1959 Thompson, Jr. ..... A41C 3/00 450/40
2,983,274 A * 5/1961 Plehn ..... A41C 3/0028 450/65
3,006,175 A * 10/1961 Morgan ..... A41B 9/02 66/177
3,322,120 A * 5/1967 Wyss ..... A41B 9/02 2/403
3,434,478 A * 3/1969 Cohen ..... A41C 5/005 28/153

(Continued)

FOREIGN PATENT DOCUMENTS

GB 2475234 A * 5/2011 ..... A41B 9/02
WO WO-0154522 A1 * 8/2001 ..... A41B 9/02

*Primary Examiner* — Alissa L Hoey
(74) *Attorney, Agent, or Firm* — Sagacity Legal PLLC

(57) ABSTRACT

A seamless male garment including a front panel and a rear panel joined together forming a the crotch area and legs, and an integrally molded pouch formed in the front panel to enclose male genitals, wherein the breathability of the pouch is greater than the rest of the front panel and the back panel. A method of forming a pouch in male garment made from a synthetic composite fabric, the method including providing a die comprising a cup-shaped male component and a corresponding cup-shaped female component, stretching a front panel of the male garment over the male component to increase the diameter of the holes in the composite fabric and then pressing the stretched front panel with the female component with heat being applied to the front panel.

6 Claims, 3 Drawing Sheets

(56) References Cited

U.S. PATENT DOCUMENTS 3,981,310 A * 9/1976 Donaghy ..... D04B 21/207 450/40
4,202,853 A * 5/1980 DiTullio ..... B29C 51/004 83/14
4,481,951 A * 11/1984 Cole ..... B29C 51/145 29/445
4,555,378 A * 11/1985 Martin ..... B29C 51/08 425/398
4,572,195 A * 2/1986 Hyams ..... A41C 5/005 264/258
5,131,100 A * 7/1992 Atwater ..... A41B 9/02 2/403
5,855,124 A * 1/1999 Donaghy ..... D04B 21/18 450/40
6,299,505 B1 * 10/2001 Huang ..... A41C 3/144 450/57
6,398,620 B1 * 6/2002 Huang ..... A41C 3/144 450/57
7,214,120 B2 * 5/2007 Kaye ..... A41C 3/10 450/39
7,422,508 B2 * 9/2008 Bentham ..... A41C 3/0014 2/243.1
7,437,774 B2 * 10/2008 Baron ..... D03D 15/50 2/DIG. 2
7,442,110 B2 * 10/2008 Gaudet ..... A41C 3/144 450/39
7,631,369 B2 * 12/2009 Geiwald ..... A41B 9/02 2/403
7,722,432 B2 * 5/2010 Wood ..... A41C 5/005 450/39
7,774,865 B2 * 8/2010 Miller ..... A41D 1/089 2/403
7,776,770 B2 * 8/2010 Wang ..... B29C 51/004 442/329
9,044,329 B2 * 6/2015 Ziehler ..... A41B 9/023
9,210,955 B2 * 12/2015 Dandapure ..... A41C 5/005
9,232,823 B2 * 1/2016 Mitchell ..... D04B 1/106
9,332,792 B2 * 5/2016 Harber ..... A41D 13/002
10,045,570 B2 * 8/2018 Hoeven ..... A41C 3/0028
10,085,492 B2 * 10/2018 Polidan ..... A41B 9/001
10,165,801 B2 * 1/2019 Blibech ..... A41B 9/02
10,342,266 B2 * 7/2019 Oh ..... A41B 9/023
10,542,782 B2 * 1/2020 Shupe ..... A41B 9/023
10,779,578 B2 * 9/2020 Van Tiel ..... A41B 11/121
10,834,974 B2 * 11/2020 Bigney ..... A41B 9/023
10,863,779 B2 * 12/2020 Guarnaschelli ..... A41C 3/0014
D908,312 S * 1/2021 Karon ..... D2/712
11,147,718 B2 * 10/2021 LaVon ..... B29C 65/48
11,213,078 B2 * 1/2022 Mientjes ..... A41C 3/00
11,547,613 B2 * 1/2023 Ashraf ..... A61F 13/15764
11,606,992 B2 * 3/2023 Pezzimenti ..... A41D 27/28
2006/0005301 A1 * 1/2006 Taylor ..... A41B 9/02 2/403
2006/0162052 A1 * 7/2006 Stankowski ..... A41B 9/02 2/403
2008/0132133 A1 * 6/2008 Yasui ..... D03D 15/283 442/200
2008/0229487 A1 * 9/2008 Kweon ..... A41B 9/023 2/403
2012/0255201 A1 * 10/2012 Little ..... A43D 111/00 12/142 R
2014/0215685 A1 * 8/2014 Bush ..... A63B 71/146 2/161.1
2016/0309792 A1 * 10/2016 Adriaansen ..... A41B 9/02
2016/0338415 A1 * 11/2016 Aihara ..... A41B 1/08
2017/0071275 A1 * 3/2017 Darby ..... A41B 17/005
2018/0132538 A1 * 5/2018 Yan ..... A41B 9/14
2019/0048521 A1 * 2/2019 Meemaduma ..... B29C 51/145
2019/0125002 A1 * 5/2019 Cox ..... A41B 9/023
2019/0233988 A1 * 8/2019 Harada ..... D02G 3/443
2020/0297040 A1 * 9/2020 Weber-Unger ..... A41B 9/02
2021/0169153 A1 * 6/2021 Inselberg ..... A41C 3/0014
2021/0212386 A1 * 7/2021 Jamieson ..... A41B 9/023
2021/0259326 A1 * 8/2021 Shaughnessy ..... A41B 9/001
2021/0274856 A1 * 9/2021 Blythe ..... A41B 9/14
2022/0047022 A1 * 2/2022 Almog ..... A41D 31/04
2022/0346461 A1 * 11/2022 Wittrock ..... A41B 9/02
2022/0378116 A1 * 12/2022 Morris, V ..... A41D 1/067
2023/0043323 A1 * 2/2023 Vitarana ..... A41B 9/14

* cited by examiner

SEAMLESS MALE GARMENT

TECHNICAL FIELD

This invention relates generally to male garments, and men's and boy's undergarments in particular and methods of manufacture.

BACKGROUND

Conventional men's undergarments, such a men's briefs, can be uncomfortable for the wearer and exhibit low breathability. An improved male undergarment would be desirable.

SUMMARY

According to one aspect of the present disclosure there is provided a seamless male undergarment including an integral fabric pouch for male genitalia.

According to another aspect of the present disclosure there is provided a seamless male garment including a front panel and a rear panel joined together forming a the crotch area and legs, and an integrally molded pouch formed in the front panel to enclose male genitals, wherein the breathability of the pouch is greater than the rest of the front panel and the back panel. The garment may be a male undergarment such as male underwear.

According to another aspect of the present disclosure there is provided a method of forming a pouch in male garment made from a synthetic composite fabric, the method including providing a die comprising a cup-shaped male component and a corresponding cup-shaped female component, stretching a front panel of the male garment over the male component to increase the diameter of the holes in the composite fabric and then pressing the stretched front panel with the female component with heat being applied to the front panel. The garment may be a male undergarment such as male underwear.

DRAWINGS

Various embodiments of the present invention will now be described with reference to the drawings, in which.

DETAILED DESCRIPTION

Figure 1:
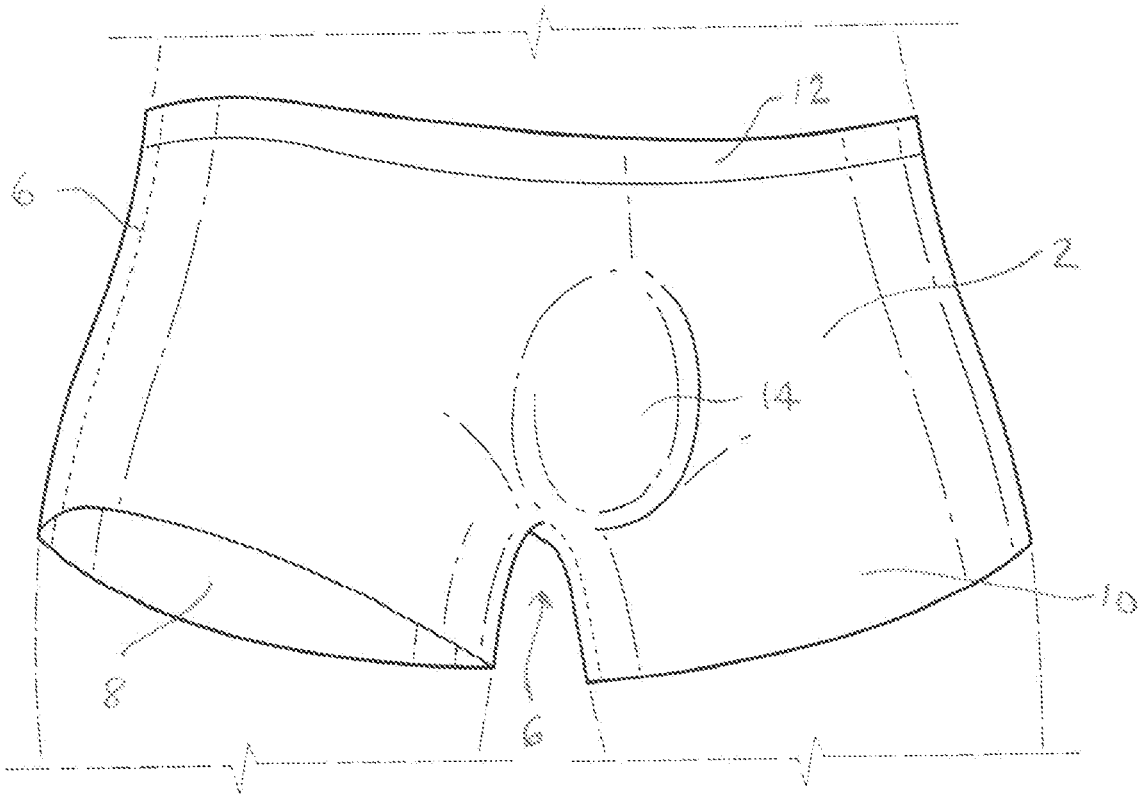
FIG. 1 is a front perspective view of a seamless male undergarment according to an embodiment of the present invention.
Figure 2:
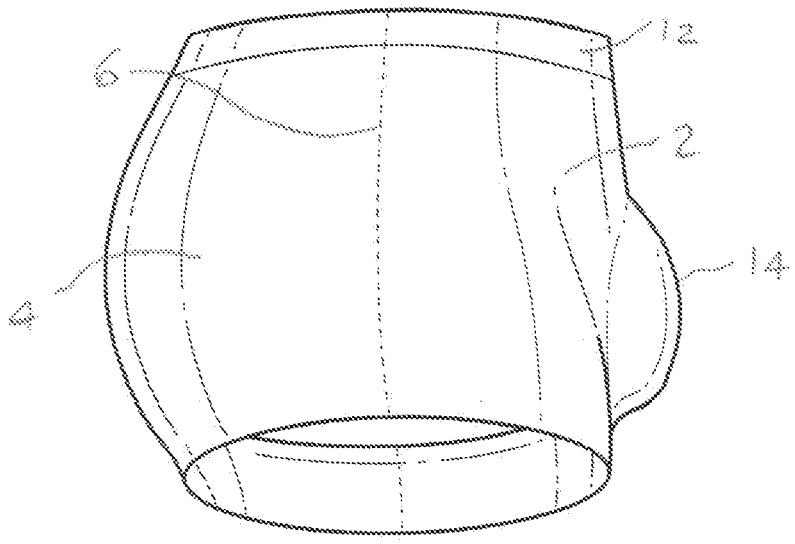
FIG. 2 is side perspective view of the seamless male undergarment of FIG. 1.
Figure 3:
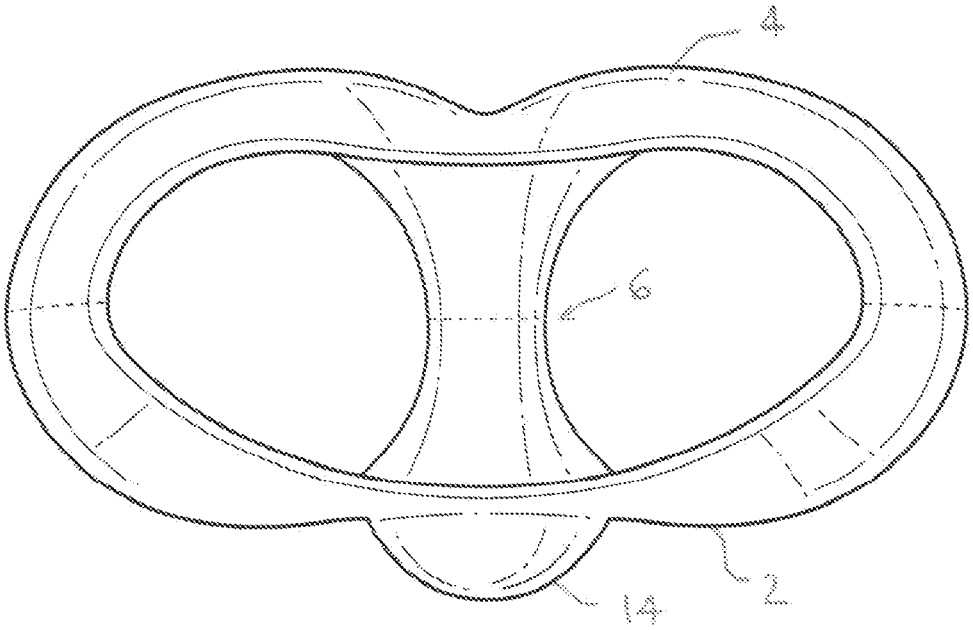
FIG. 3 is bottom view of the seamless male undergarment of FIG. 1.
Figure 4:
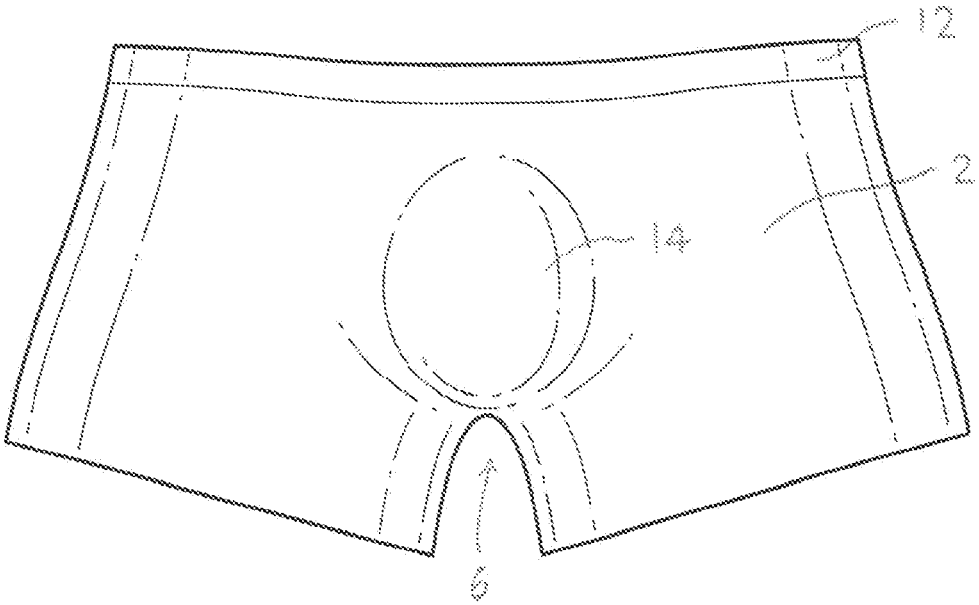
FIG. 4 is a front view of the seamless male undergarment of FIG. 1.
Figure 5:
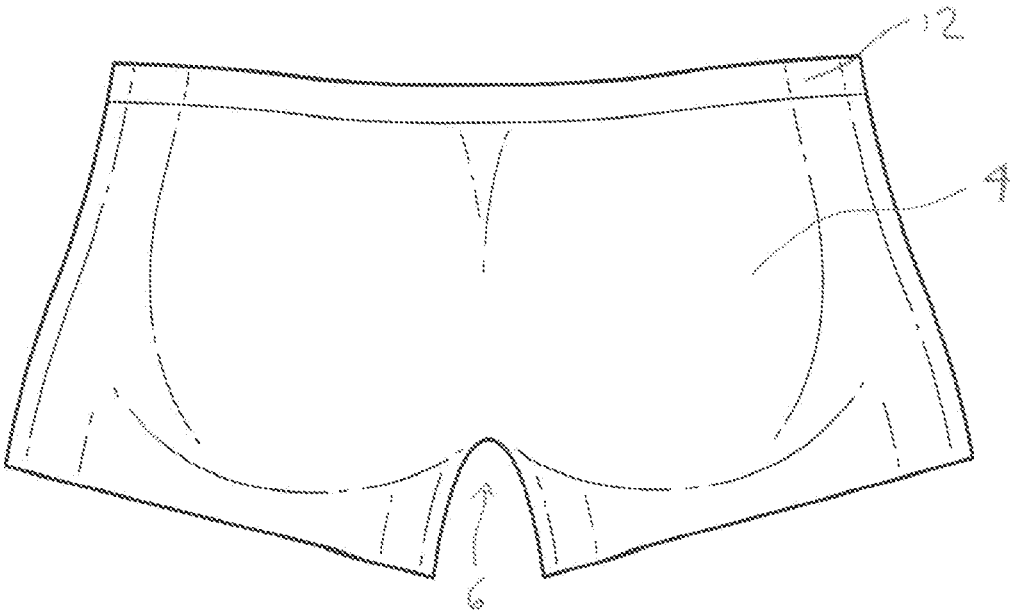
FIG. 5 is a rear view of the seamless male undergarment of FIG. 1.
Figure 6:
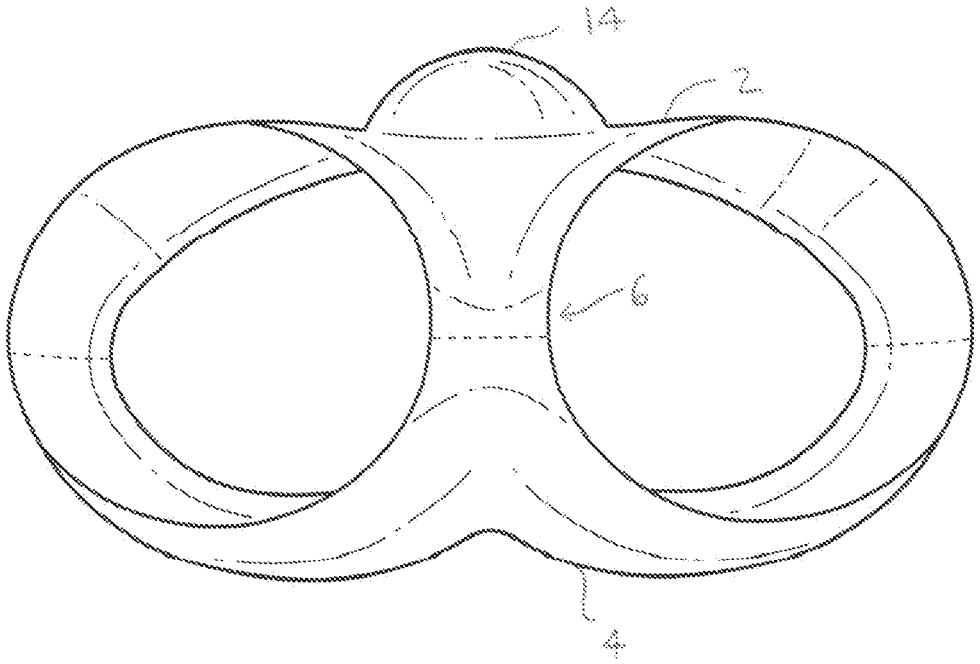
FIG. 6 is bottom perspective view of the seamless male undergarment of FIG. 1.

Referring to the figures, an undergarment according an embodiment of the present invention are fabricated from a front panel 2 and the rear panel 4 of material. The ends of the front and rear panels are overlapped at the sides and the overlapped region is fused using an adhesive to form sutureless joins. The joins stretch vertically to move with the body unlike seams made with sutures.

The front 2 and rear 4 panels are joined together in the crotch area in indicated generally at 6. The legs 8 and 10 of the undergarment have a hem formed of a band of fabric upturned on the inside of the legs and sealed with an adhesive. The waist includes an elasticized waist band 12. The upper ends of the front and rear panels are folded over the waist band and heat sealed to enclose the waist band. This provides a seamless waist band which mitigates irritation caused by waist band chaffing against the wearer's skin. It also helps to mitigate wear and breakage of the waist band.

The undergarment includes an integrally molded pouch 14 in the front panel to enclose male genitals and to provide comfort to the wearer. The absence of seams between the pouch and the front panel prevents chaffing caused by sutured seams. The breathability of the fabric forming the pouch is greater than that of the rest of the front panel and the back panel. In one embodiment, the fabric is a synthetic composite fabric of approximately 86% Creora® Polyamide and approximately 14% Spandex® or Lyrca®. In one embodiment, the fabric includes elongated nano fibres where the fibres that make up each thread are longer than in conventional materials which allows for greater strength and stretch recovery. In another embodiment, the fabric is made using a conventional polyamide weave that is transformed to a statin weaved and thinned out. The present inventor refers to the satin weave material as Stealthweave™. In another embodiment, the synthetic fabric has a thickness in the range of 0.0045-0.0048 mm. In certain embodiments, the composite fabric forming the pouch has a fabric matrix with approximately 0.25 mm diameter holes, 0.05 mm diameter holes, or in the range of 0.025 mm-0.05 mm diameter holes, in between warp and filament yarn, whereas the rest of the front panel, as well as the rear panel, has a fabric matrix with approximately 0.01 mm diameter holes, 0.1 mm diameter holes, or in the range of 0.01 mm to 0.1 mm diameter holes in between warp and filament yarn. The holes serve as aeration holes. A spacing of 0.01 mm for the panels and 0.025 mm for the pouch is suited for sports activities underwear, while a spacing of 0.05 mm in the pouch is suited for recovery underwear. The higher spacing provides greater breathability, airflow, and humidity and heat dissipation from the groin to cool the male genitals to an optimal temperature range, while at the same time providing adequate support for the wearer's genitals. This promotes sperm health.

Prior to assembly, the fabric is heat pressed on steel rollers to improve the softness of the fabric and to reduce the coefficient of friction which reduces chaffing against the wearer's skill.

The pouch is formed in the front panel prior to assembly using a die molding method. The mold is made of brass and includes cup-shaped male and female components in a die press. To mold the pouch, the front panel is stretch over the male component which increases the diameter of the holes, and then pressed with the female component with heat being applied. The pouch is then cooled fixing the size of the aeration holes. The size of the aeration holes can be controlled by the degree of stretching applied to the fabric when stretched over the male component.

In another embodiment, the elastic waistband 12 is omitted and replaced by a polypropylene elastomer. The elastomer is applied in liquid form to the fabric at the waist using double sided tape to the waist of the underwear and allowed to harden on the fabric and the tape is peeled off. In one embodiment, the elastomer forms a waistband ribbon 1.5 cm wide and 0.3 mm thick on the of the waist of the underwear. Such an elastomer waistband is more durable than conventional elastic waistbands. In one embodiment, the elastomer waist is 50% thinner than a conventional elastic waist band and the breakage and warping associated with conventional elastic waist bands is avoided.

What is claimed is:

1. A seamless male garment comprising:

a front panel and a rear panel joined together forming a crotch area and legs, the front panel and the rear panel formed from a synthetic composite fabric; and an integrally molded pouch formed in the front panel to enclose male genitals when worn, wherein the synthetic composite fabric forming the front panel other than an area of pouch, and the rear panel, includes a fabric matrix with holes in a first range of 0.01 mm to 0.024 mm diameter holes, in between warp and filament yarn, the synthetic composite fabric forming the pouch includes a fabric matrix with holes having a diameter in a second range of 0.025 mm to 0.05 mm in between warp and filament yarn different from the first range, such that a breathability of the pouch is greater than that of the front panel other than the area of the pouch, and the rear panel, and the synthetic composite fabric comprises 86% polyamide and 14% elastane fabric.

2. The garment of claim 1, wherein the composite fabric has a thickness in the range of 0.0045-0.0048 mm.

3. The garment of claim 1, wherein the composite fabric comprises elongated nano fibres.

4. The garment of claim 1, wherein the composite fabric comprises a polyamide weave that has been transformed to a satin weave and thinned out.

5. The garment of claim 1, further comprising a waist formed of a polypropylene elastomer applied to the synthetic composite fabric.

6. A garment comprising:

a front panel and a rear panel joined together forming a crotch area and legs, the front panel and the rear panel formed from a synthetic composite fabric; and an integrally molded pouch formed in the front panel to enclose male genitals when worn, wherein the pouch is formed using a die molding method using a die comprising a cup-shaped male component and a corresponding cup-shaped female component, and further comprising stretching the front panel over the male component to increase the diameter of the holes in the synthetic composite fabric forming the pouch and then pressing with the female component with heat being applied, the synthetic composite fabric forming the front panel other than an area of pouch, and the rear panel, includes a fabric matrix with holes in a first range of 0.01 mm to 0.024 mm diameter holes, in between warp and filament yarn, the synthetic composite fabric forming the pouch includes a fabric matrix with holes having a diameter in a second range of 0.025 mm to 0.05 mm in between warp and filament yarn different from the first range, such that a breathability of the pouch is greater than that of the front panel other than the area of the pouch, and the rear panel, and the synthetic composite fabric comprises 86% polyamide and 14% elastane fabric.

* * * * *